United States Patent [19]

Staudte, Jr.

[11] 3,964,712

[45] June 22, 1976

[54] APERTURED PANEL BRACKET

[76] Inventor: Walter J. Staudte, Jr., 514 S. 15th, Sunnyside, Wash. 98944

[22] Filed: Feb. 5, 1975

[21] Appl. No.: 547,119

Related U.S. Application Data

[62] Division of Ser. No. 387,625, Aug. 13, 1973, Pat. No. 3,879,006.

[52] U.S. Cl. ..... 248/223; 248/DIG. 3

[51] Int. Cl.[2] ..... E06B 7/28; A47F 5/00

[58] Field of Search ..... 248/223, 224, 225, 220.5, 248/DIG. 3; 211/87, 59

[56] References Cited

UNITED STATES PATENTS

| | | | |
|---|---|---|---|
| 2,841,353 | 7/1958 | Burdick | 248/224 |
| 2,961,724 | 11/1960 | Alling | 248/DIG. 3 UX |
| 3,070,339 | 12/1962 | Schayer | 248/223 |
| 3,244,390 | 4/1966 | Kerr | 248/225 |
| 3,452,954 | 7/1969 | Lucietto et al. | 248/220.5 |
| 3,565,379 | 2/1971 | Messier | 248/223 |
| 3,677,415 | 7/1972 | Radek | 211/59 |

*Primary Examiner*—J. Franklin Foss
*Attorney, Agent, or Firm*—B. P. Fishburne, Jr.

[57] ABSTRACT

An article support assembly for standard apertured panels comprises a stabilizing device which may be molded from plastics or fabricated from sheet metal. The device has a seating groove to receive and anchor a vertical portion of the article hanger and at least one integral stud for anchoring engagement with a panel aperture. The article hanger also possesses a stud or studs engaging through an aperture of the device and having anchoring engagement with another aperture of the panel. The support assembly may span panel apertures in a single vertical row or in a pair of rows.

4 Claims, 4 Drawing Figures

FIG. 1
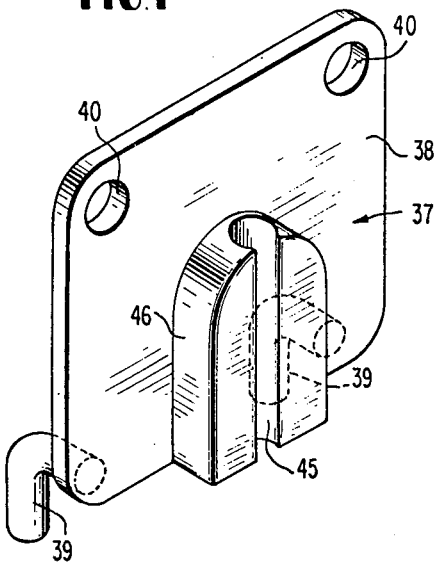
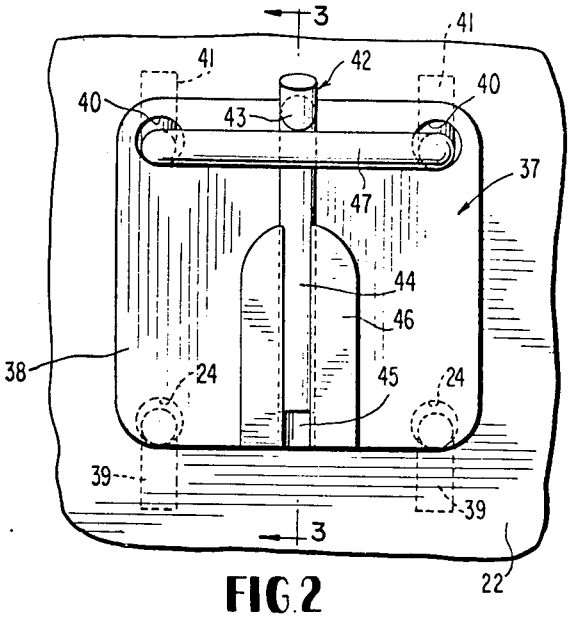
FIG. 2
FIG. 3
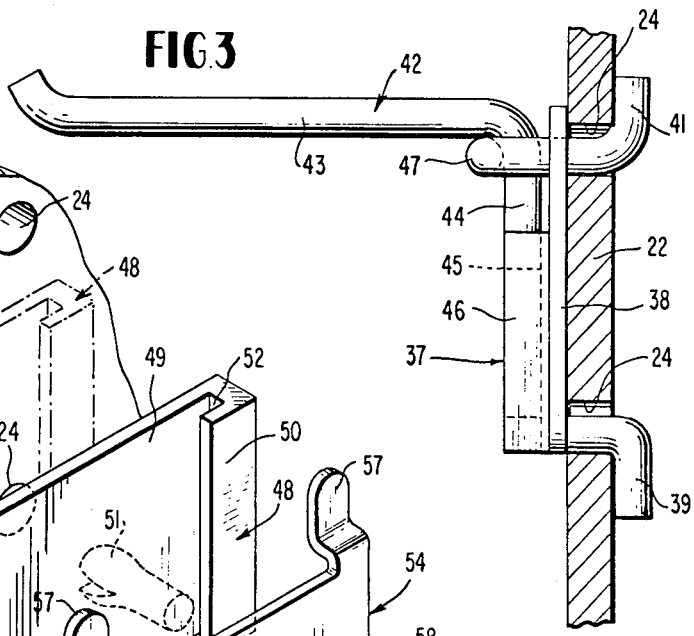
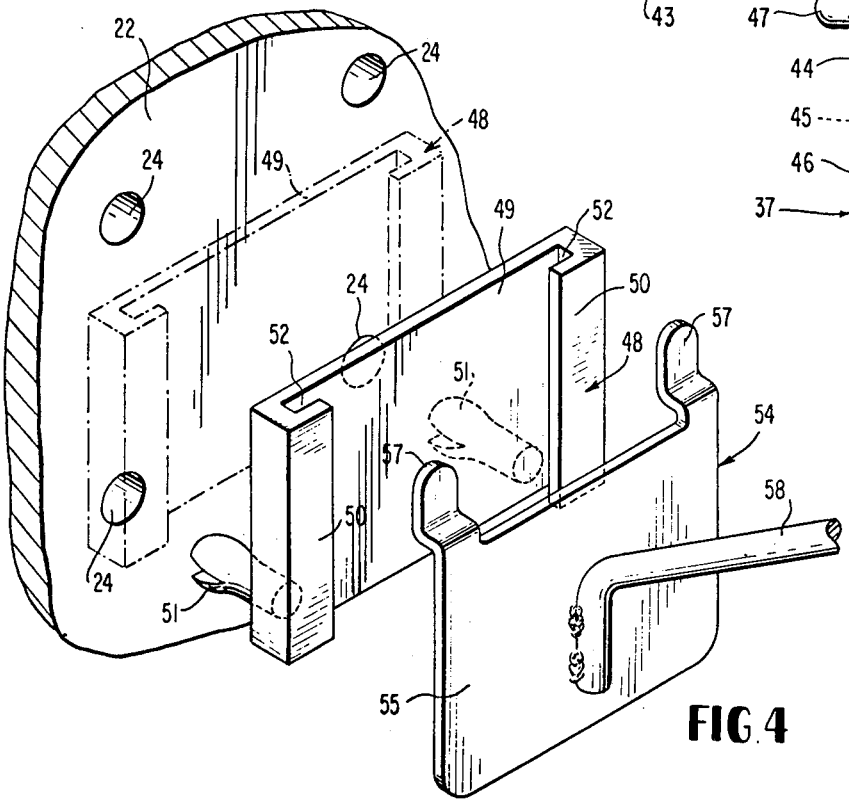
FIG. 4

APERTURED PANEL BRACKET

CROSS-REFERENCE TO RELATED APPLICATION

This application is a division of prior copending application Ser. No. 387,625, filed Aug. 13, 1973, now U.S. Pat. No. 3,879,006.

BACKGROUND OF THE INVENTION

Many forms of brackets or article support assemblies for use with apertured panels have been proposed by the prior art and some examples of the patented prior art are contained in U.S. Patent Nos. 2,933,277; 3,193,231; 3,409,260 and 3,452,954. While certain devices of the prior art have been successfully utilized to support a variety of articles on standard apertured panels, nevertheless there is an increasing need for a support assembly which is more economical to manufacture and more reliable and efficient in use, as well as more simplified.

Generally speaking, the prior art devices of this general character have either been too costly or complex to be practical in mass production or have been inadequate to support articles in terms of sturdiness and stability in the supporting position on the apertured panel.

Accordingly, it is the object of this invention to provide a highly simplified and economical support assembly or bracket means for apertured panels which is very simply engaged and separated from the apertured panel as need dictates and which has the ability to be firm and stable while engaged with the apertured panel without any tendency for accidental or premature separation from the peg board during usage for supporting a variety of articles. More particularly, the invention features an intermediate stabilizing device or member which may be molded from plastics or stamped from sheet metal. In either case, this device has studs for direct supporting engagement with one or more apertured panel openings and has a retaining stabilizing means in the form of a groove or channel for a vertical part of the customary article hanger. The hanger additionally has interlocking engagement with at least one apertured panel opening, and in so doing, engages at least one additional aperture in said device to complete the engagement or anchorage of the assembly to the standard apertured panel. The parts of the invention are very easy to manipulate and will not separate from the apertured panel unless separation or relocation of the assembly is desired. Most importantly, the article support assembly embodying the invention is very stable during use and does not wobble and is very sturdy in construction. The intermediate stabilizing device receives the load of the article suspended from the hanger and transmits this load to the apertured panel over a relatively wide surface area of the latter for maximum stability.

Other features and advantages of the invention will become apparent during the course of the following detailed description.

BRIEF DESCRIPTION OF DRAWING FIGURES

FIG. 1 is a perspective view of a stabilizing device forming a part of the support assembly for articles embodying the invention.

FIG. 2 is a front elevational view of a complete article support assembly embodying the device of FIG. 1.

FIG. 3 is a vertical section taken on line 3—3 of FIG. 2.

FIG. 4 is a perspective view showing another form of the invention.

DETAILED DESCRIPTION OF PREFERRED EMBODIMENTS

Referring to the drawings in detail wherein like numerals designate like parts, and attention being directed first to FIGS. 1 to 3, an intermediate stabilizing device 37 is shown which spans two vertical rows of panel apertures 24 and interlocks therewith. The stabilizing device 37 has a rectangular base plate 38 which lies against the forward face of apertured panel 22. A pair of lower integral L-studs 39 on the device 37 engage through a pair of the panel apertures 24 in the two rows of apertures and bear the weight of the assembly. The studs 39 lie at the rear face of the apertured panel as shown in FIG. 3.

At its top corners, the base plate 38 has two openings 40 which register with two more apertures 24 of the panel and these openings 40 and the adjacent panel apertures receive two upturned L-studs 41 carried by an article hanger 42 of the type illustrated in FIGS. 2 and 3. This hanger 42 has a horizontal forwardly projecting article support arm 43 rigid with a depending vertical portion 44 adapted to engage within a vertical groove 45 formed through a boss 46 carried by the base plate 38. As in the previous form of the invention, the device 37 may be molded of plastics or may be constructed from sheet metal, if preferred. In either case, the vertical portion 44 of hanger 42 will snap into the vertical groove 45 and be held therein as shown. A crossbar 47 forming a part of the hanger 42 is integrally joined with and carries the two upper studs 41.

The general mode of use and the advantages of the invention in FIGS. 1 to 3 are essentially the same as with the invention of FIGS. 1 to 6 in the above-referenced patent, U.S. Pat. No. 3,879,006. However, the article support assembly in FIGS. 1 to 3 of this application is even more secure and stable because of its engagement with two vertical rows of panel board apertures, as described.

FIG. 4 shows still another form of the invention where the intermediate stabilizing device 48 is in the form of a channel member having a base plate 49 and forwardly offset vertical side flanges 50. The base plate 49 abuts the forward face of the apertured panel 22 in assembly. A pair of resilient snap studs 51 are fixedly secured to the device 48 near its lower corners and are adapted for engagement releasably with one pair of panel apertures 24. The upper edge of device 48 terminates below the next uppermost pair of panel apertures 24. Laterally opposing vertical grooves or ways 52 are formed at the sides of the device 48 between the flanges 50 and base plate 49.

The hanger 54 has a plate body portion 55 adapted to be received slidably in the grooves 52 of device 48. After such engagement, a pair of upper L-studs 57 on the hanger 54 are engaged through the upper panel apertures 24 shown in FIG. 10; following such engagement the assembly is rotated downwardly so that the snap studs 51 may engage within the lower pair of apertures 24. The hanger 54 also possesses a forwardly projecting article support arm 58 of suitable formation, welded or otherwise rigidly secured to plate body portion 55. Other variations in the construction are possible including the beveling of the forward faces of flanges 50 at their interior edges so that the hanger 54 may be snapped into engagement with the grooves 52 by finger pressure relying on the resiliency of the device 48 and the beveled edges of the flanges 50. This alternative arrangement is not shown in the drawings but is entirely feasible for the form of the invention in FIG. 4.

It may now be observed that in all forms of the invention there is provided an intermediate hanger seating and stabilizing device, which device has at least a stud for supportive engagement and interlocking engagement with an aperture of the panel and the engagement takes place near the bottom of the device. The device also has a vertical groove means to seat a vertical portion of the hanger in assembled relationship. The hanger, in turn, has a stud means near its top for interlocking engagement with an additional aperture or apertures of the panel and such last-named stud means may also extend through an upper opening of the intermediate device.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. An article support assembly comprising an apertured panel body having plural vertical rows of apertures formed therethrough, an intermediate hanger stabilizing device adapted to engage the forward face of said panel body and lying between the panel body and an article hanger, said device having a vertical groove means therein adapted to receive and seat a vertical portion of an article hanger, said device comprising a flat base plate spanning two vertical rows of apertures in said panel body and having a pair of laterally spaced openings near its top adapted to register with a pair of apertures in laterally adjacent rows on the panel body, said base plate having a pair of laterally spaced studs near its bottom engageable within a pair of laterally spaced apertures in said panel body, an article hanger having a vertical part engageable releasably within said vertical groove means and seated therein and being stabilized thereby, and a pair of studs on said article hanger near its top engageable through said openings of the base plate and through a registering pair of apertures in said panel body.

2. The structure of claim 1, and said studs of the base plate being downturned L-studs and said studs on said article hanger near its top being upturned L-studs.

3. An article support assembly comprising an apertured panel body having plural vertical rows of apertures, an intermediate hanger stabilizing device adapted to engage the forward face of said panel body and to lie between the panel body and an article hanger, said device comprising a channel member having a base plate and a pair of forwardly spaced vertical side flanges, said device having vertical groove means adapted to receive and seat a vertical portion of an article hanger and said vertical groove means comprising a pair of vertical grooves at the opposite sides of the device between said flanges and base plate, an article hanger comprising a plate body portion having vertical edges received within said pair of vertical grooves of said device, a pair of laterally spaced studs on said device near its bottom engageable within a pair of adjacent apertures in said panel body, and a pair of studs on said article hanger near its top engageable through another pair of adjacent apertures in said panel body.

4. The structure of claim 3, and said pair of studs on said device being resilient snap studs, said pair of studs on the article hanger being rearwardly offset and upturned L-studs.

* * * * *